US008525698B2

(12) United States Patent
Al Shahrani

(10) Patent No.: US 8,525,698 B2
(45) Date of Patent: Sep. 3, 2013

(54) SECURITY GATES DEVICE

(76) Inventor: Hmoud Sayaf Al Shahrani, Khamis Mushait (SA)

( * ) Notice: Subject to any disclaimer, the term of this patent is extended or adjusted under 35 U.S.C. 154(b) by 722 days.

(21) Appl. No.: 12/757,629

(22) Filed: Apr. 9, 2010

(65) Prior Publication Data

US 2010/0259361 A1 Oct. 14, 2010

(30) Foreign Application Priority Data

Apr. 11, 2009 (SA) ..... 109300217

(51) Int. Cl.
*G08B 29/00* (2006.01)

(52) U.S. Cl.
USPC ..... 340/907; 404/6; 404/7; 404/8; 404/17; 340/5.7

(58) Field of Classification Search
USPC ..... 340/5.71, 907; 378/57, 195–197; 250/358.1; 404/6, 72, 17–3
See application file for complete search history.

(56) References Cited

U.S. PATENT DOCUMENTS

| | | | | |
|---|---|---|---|---|
| 6,972,693 | B2 * | 12/2005 | Brown et al. | 340/907 |
| 2007/0177940 | A1 * | 8/2007 | Marsh et al. | 404/6 |
| 2009/0092443 | A1 * | 4/2009 | Friedman et al. | 404/6 |
| 2011/0020062 | A1 * | 1/2011 | Mahal et al. | 404/6 |

* cited by examiner

*Primary Examiner* — Nabil Syed
(74) *Attorney, Agent, or Firm* — Sughrue Mion, PLLC

(57) ABSTRACT

The security gate device is the one that has the ability to deter and seize unauthorized vehicles to enter and that attempt to envade the place; this can be done automatically without giving human being orders. The device is equipped with a room consisting of bumpers and anti-blast walls to protect the facility and the workers from damage caused by such an explosion. Meanwhile, this device can arrest the intruders of the gate.

22 Claims, 7 Drawing Sheets
(1 of 7 Drawing Sheet(s) Filed in Color)

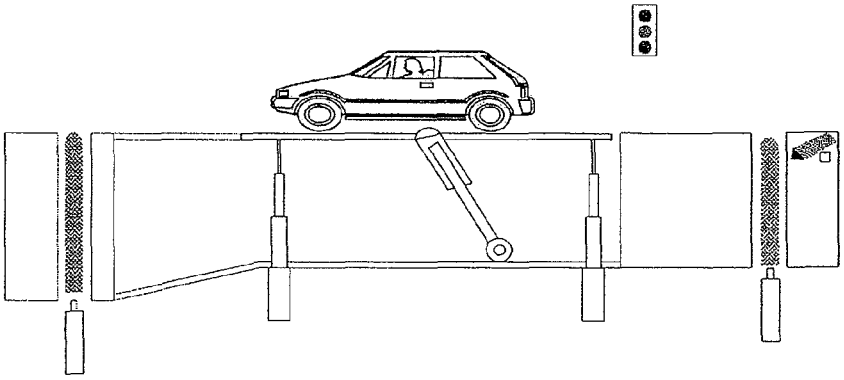
Figure
2
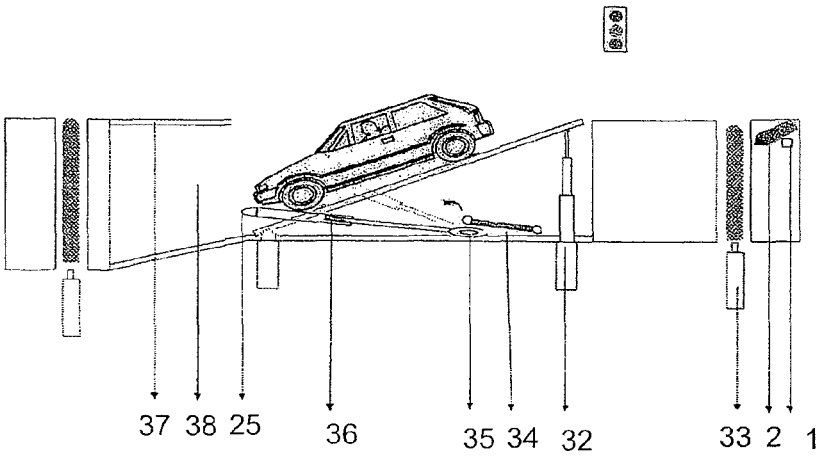
Figure 3

SECURITY GATES DEVICE

INVENTION BACKGROUND

In the present condition of the security gates, there is no technical security method that avoids the power of the blast and the direction of the blast fragments to protect the facility and the workers from the damage of the explosion. Additionally, in case of the loss of the gate worker for whatever circumstances, the attacker will pass by the gate peacefully into the facility. It is noted in the current security gates that there is a concentration in the concrete works that caused traffic problems and have disadvantages for those who are authorized to enter the facility as well as visitors. When a vehicle is impounding the gate, there is the problem of resisting and arresting the persons and weapons might be used. Also, if the vehicle is sopped through the present bumpers available, the vehicle and the persons will be exposed to serious injuries due to the sudden stoppage besides the attacker can retreat and escape.

GENERAL DESCRIPTION OF THE INVENTION

The current invention is characterized that it protects the guards and the facility from the blast damages with guards help. Individuals and the vehicles of all types cannot pass by the gate in an irregular method as the device will impound the vehicle attempting to escape or retreat if the attack fails. Additionally, it prevents the unauthorized vehicles from entering through their weights and identifies the vehicle weight upon entering and when they exit after being loaded with the materials. One of the features of the device is that it can be used as explosives detector as well as weapons detector programmed with a device for a comprehensive security protection.

Individuals are arrested without the use of a military troop and the use of arms, where the one who climbs the gate to assault is arrested without much effort when turning on the comprehensive security protection. The device is also considered to be effective in its performance in carrying out its security duties without causing injuries to the attackers or the guards. The device is also characterized for being able to stop the precipitous vehicle and to absorb its speed then make it stop to avoid injuries as a result of the sudden stop as the device is equipped with speed bump to reduce speed while passing over it at the same time it is used to absorb speed of the precipitous vehicle in case it tries to intrude.

Other feature of the security gates device is that it is invisible and no one can notice that it exists at the gate. Its size is small and can hold large vehicles through its front tunnel. While the device is operating, it can produce a vehicle lights toward the intruder. Also, the device has the ability to deter the second and third intrusion supporting the first intrusion automatically. It directly operates the warning alarm and a camera to record the actions that the can be utilized in investigation. It operates through programming the comprehensive security protection and reduces the number of guards at end of the working hours or when the sun sets as needed. The device can be equipped with a system of remote control, fingerprint, or PIN used by the guards so that no one can use it. The device can arrest the intruders without losses in human lives. Also, it is equipped with an electronic card system as well as a system to count vehicles entering the gate with the ability to identify their types, number and the date. It allows the employee vehicles to get in through the gate automatically to avoid any traffic congestion.

BRIEF DESCRIPTION OF FIGURES

The patent or application file contains at least one drawing executed in color. Copies of this patent or patent application publication with color drawing(s) will be provided by the U.S. Patent and Trademark Office upon request and payment of the necessary fee.

FIG. 2: a side image of the protection device showing an authorized vehicle passing through, and the explosion bumpers turned off to allow the vehicle get into the facility peacefully.

FIG. 3: a side image of explosion bumpers room explaining the rising up of the bumpers in front of the vehicle so at to absorb the speed of the vehicle and to stop it accordingly.

DETAILED DESCRIPTION

Figure 1:
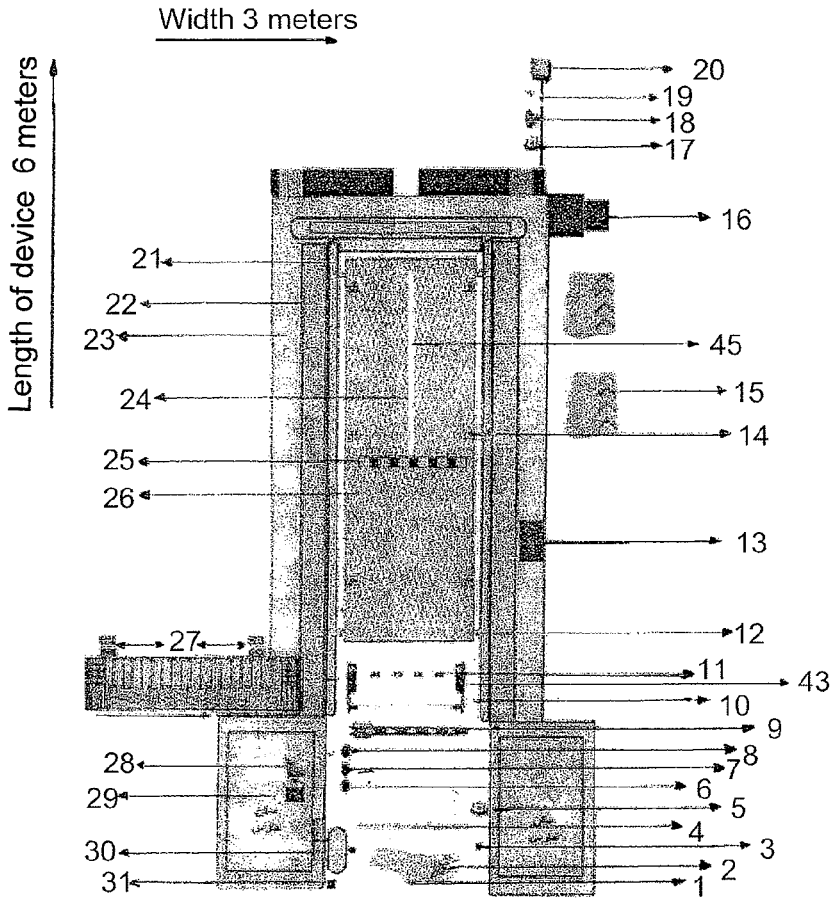
FIG. 1: a top image of the protection device in standby status showing the details of the device.
Figure 4:
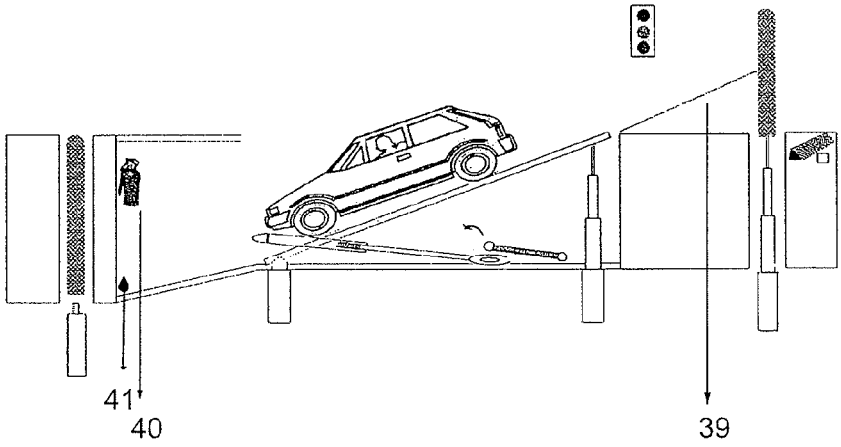
FIG. 4: a side image of explosion bumpers room showing the rising up of the back side of the vehicle to force it to get into the room.

When any vehicle enters the gate, a special device operates with metal parts (31) to identify the vehicles if they are authorized or not. If the vehicle is authorized to enter, it passes safely and during this stage the sensor will be in green color (10) which allows the vehicle to pass through peacefully. If the vehicle is unauthorized, then the sensor signal (10) will stay in red color which means that the vehicle must stop to be inspected by the security guards. While inspecting the vehicle, the explosives detector (7) and the arms detector (7) in addition to a detector equipped with a camera and a screen (6) will operate. These devices are directed by the security guard in the special room using the screen for this purpose. The sensitive device (10) is connected with an entering signal which so they work together simultaneously. When the authorized vehicle enters, it passes over the surface of the device (26) that equals to the ground surface and the vehicle also passes through an artificial low speed plumb (25) that allow the vehicle to pass and to oblige the vehicle to abide by the speed limit.

Figure 5:
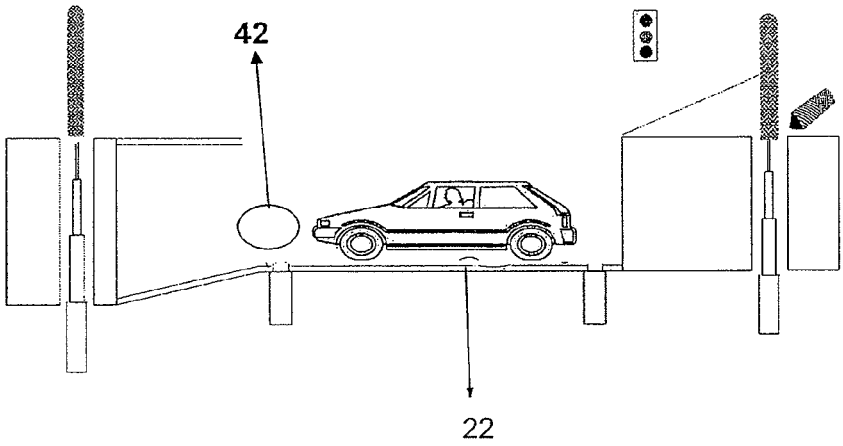
FIG. 5: a side image of explosion bumpers room showing the vehicle getting into the room completely.

In case the unauthorized vehicle enters and tries to intrude the gate and trespass the red light (43), the security system will operate. As when the vehicle intrudes the gate and passes through the ray (10) and the ground pad (11) and when the security system operates, it works through stages. Firstly, the four are released and the bump starts to rise up (25) to turn into a source of absorbing the vehicle speed, and absorption method is through pushing the bumper forward within the track (24), during this the surfaces of the device (26) is forced to go down from the front side and is balanced by a rubber spring (44) to protect the vehicle to collide with the room floor. The speed bump operates (25) and rising up by air pistons and spring (36). The track (24) includes a sensor (45) in its center as when the bump moves upon it, the sensor gives a signal that the vehicle in the middle of the device surface responds to the hydraulic pump responds so as to operate all the air pistons of which the piston (32) which pushes down the device surface from backside and pushing up the side frames (21) to hook up the intruders and prevent them from running away from the vehicle on their feet. In addition, the backstop (2) on the entry of the gate rises to deter any additional intrusion on the gate. Moreover, a frame rises in the front side (4) to arrest the intruders and deter any walking persons. Moreover, one of the devices that are operating during intrusion is the alarm bell for workers (5), a warning bell within the facility (17) a security vibratory (18), and a security camera (19) to record the events of the intrusion and transfer them to the monitoring screens and a loopy lighting (20) that is directed towards the intruder so as not to see what is behind the lighting. Also, when the device operates and the vehicle enters inside the room, the main gate will be closed (27). In so doing, the intruding vehicle will be inside the room as in FIG. 5 trapped inside the walls of the room provided by the bombing fender (22).

Figure 6:
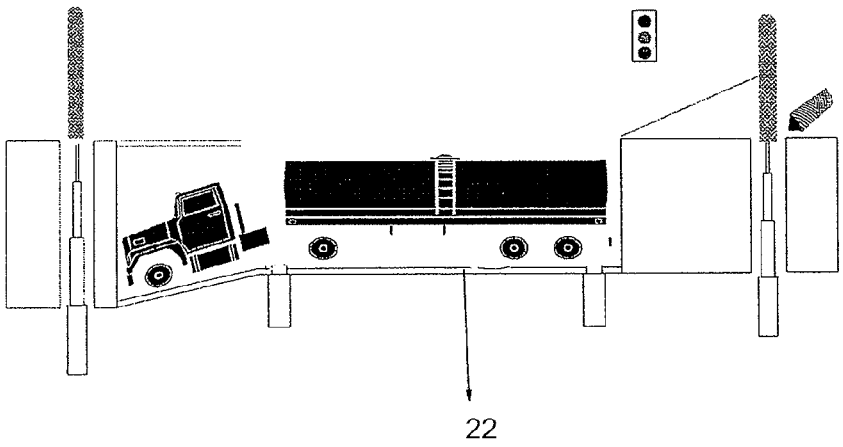
FIG. 6: a side image of explosion bumpers room showing the tunnel in the front to accommodate the large vehicles.
Figure 7:
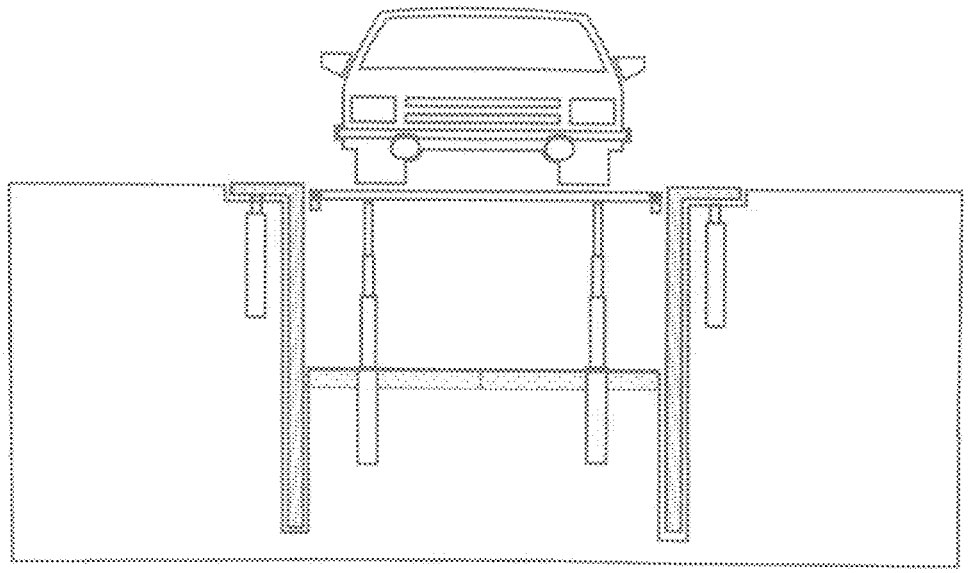
FIG. 7: a front image of explosion bumpers room showing the authorized vehicles passing by the gate peacefully and the room is turned off to allow the vehicle to get in peacefully.
Figure 8:
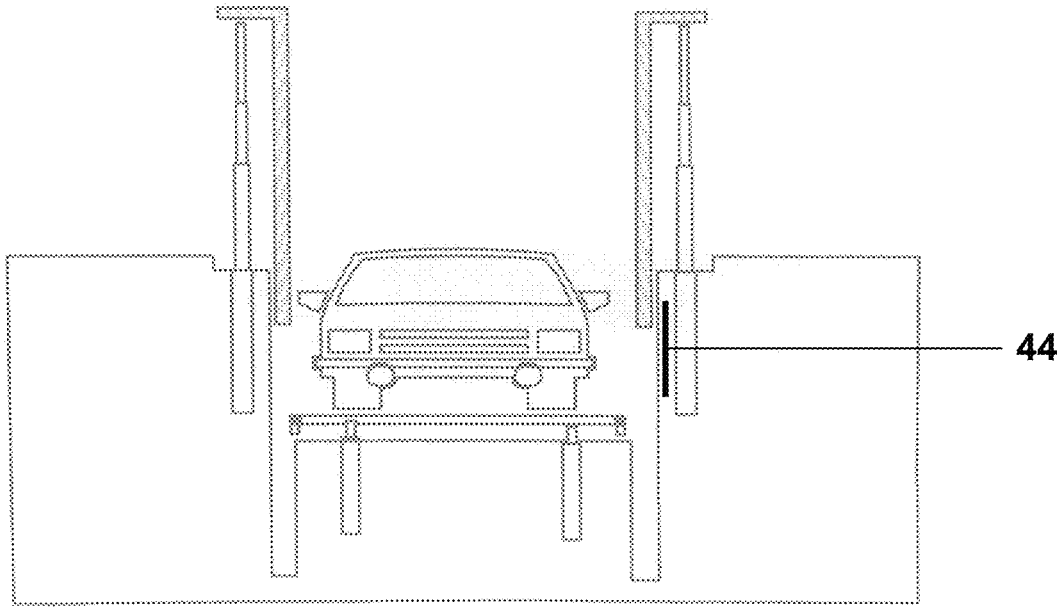
FIG. 8: a front image of explosion bumpers room showing the vehicle getting into the room describing the high of the side cages which arrest the individuals.
Figure 9:
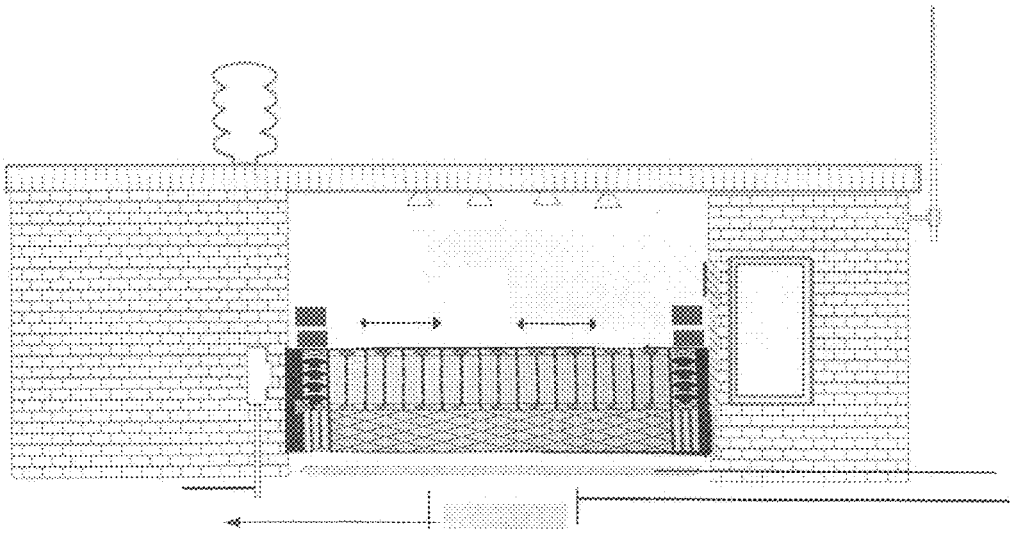
FIG. 9: a front image describing the main gate of the facility and describes the sensors positions located in front of the gates as well as it describes the weighing machine and the bunker.

The room can be expanded and to be provided with a front tunnel (37), (38), to accommodate trucks and large vehicles, as shown in FIG. 6). When the intruding vehicle is stopped by the roof of the device (26) and it tries to go back to escape the fender (4), it rises from the rear side of the vehicle lifts it from behind by wire (39) to force the vehicle to advance and go into the fender room.

Figure 10:
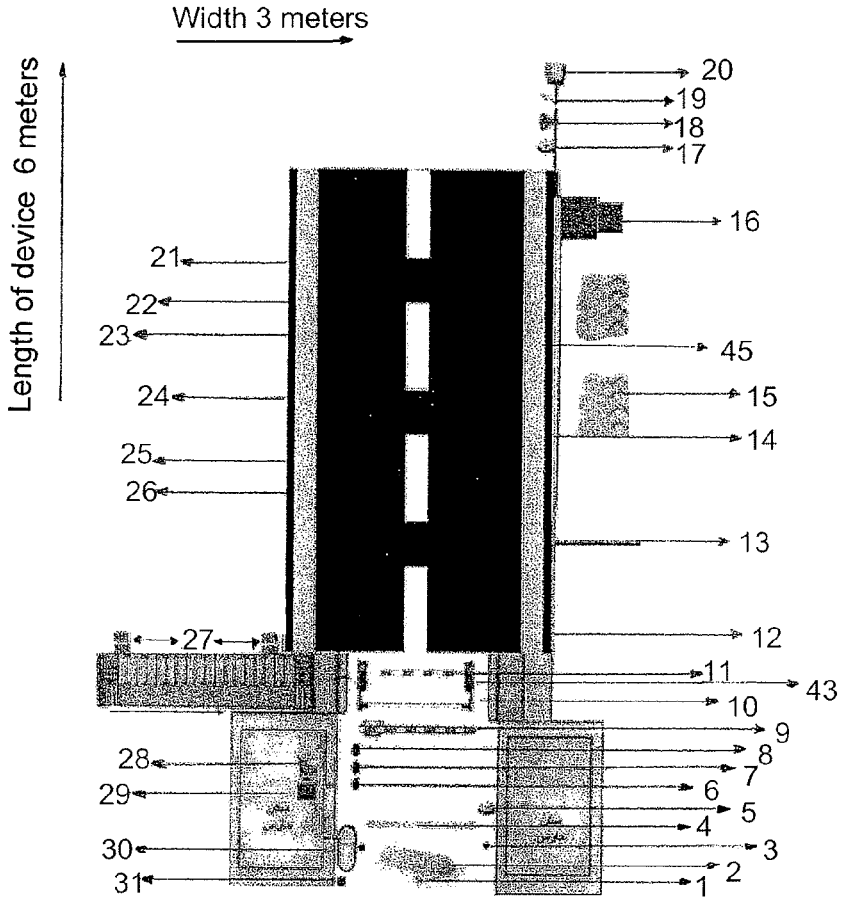
FIG. 10: a top image of explosion bumpers room showing how the roof of the room is concealed.

When the intruding vehicle blasts inside the room, it shall be trapped inside the room by the fenders (22) that force the blast to go up where the concrete ingots are available around the security device (15) to prevent the spread of fragments from spreading, also these ingots (15) force the vehicles to pass over the surface of the security device (26). One of the features of the surface of the device is that tit concealed (26) and no one feels its presence in the gate, as shown in FIG. 10).

When the intruders climber the main gate (27), the sensors of the gate operates to give a signal to the nets (21) from all the four sides to arrest the persons inside them and operating the apparatuses 175, 18, 19,20. The device can be connected with solar cells (16) so that the security gate is closed in the evening by pushing the surface of the device (26) from the front side and remove the studs (12) and pushing up the frontal bumper (2), and also raise bumper (25) and also solar-powered cat eyes (14) are placed on the surface of the security device (26).

The security device can be fully linked with a remote control and the signals can be received through a receiver (13). Before the vehicle enters to pass the security gate it passes by a sensor (3) to prevent entry duplication of several vehicles simultaneously. The bottom of the fender (2) can be equipped with an electronic device (1) for weight so as to weight of vehicles entering the gate and also to determine the weight of the vehicle when it leaves the facility after loading it with the materials, as well as to prevent the entry of the violating vehicles, whether trucks or cars.

A Ground Gates Security Device

1—When the intrusion vehicle is stopped, this is done though two stages:
   a. It absorbs the vehicle speed within several meters.
   b. It fully stops the vehicle so as to avoid any injuries as a result f the sudden stop.

2—It will not be allowed for any vehicle to enter when it intrudes the gate so the vehicle is detained whether it is a heavy or light transportation vehicle, even if it is 4×4 as well as the passengers whatever their total. Any person violate the system cannot retreat or flee as well as he will not be able to proceed in entering and passing by the gates.

3—It detains the persons who get out of the vehicle when it is detained by the device and want to walk whatever their total.

4—Detaining the vehicles and persons violating the system at the gate as it is equipped with a ready system to deter any additional assault after the previous assault. It also ready to deter the second, third, and fourth intrusion supporting the first intrusion. Nevertheless, it detains the first intruder in the same time.

5—It gives a command to turn on the alarm system inside the facility for the workers or the person who is in charge of the facility. It should be having a distinguished for all to support the official gate as well as being alert.

6—It gives a command of turning on buttons of strong lighting. These buttons do not operate except by the command of the device as the previous basic lighting can be destroyed at the gate and on the way to the facility. Thus, new lightings can be destroyed and on the way to the facility as the new lightings work and the reason is that:
   a. The intruder does not exploit the dark nights.
   b. To introduce conducing curvy lightings so that the intruder cannot see what is behind the lighting
   c. The imaging for cameras shall be clearer and accurate in determining the description of the one who violates the rules.

7—An order is given to the video camera to record all the action (sound and image) just to help in identification of the action.

8—The command is given to run cameras installed at the gate and on the way leading to the facility to for a live streaming on a large screen inside the facility available at the employee in charge or the other employees.

9—An alarm is given to those at the main gate the device has been turned on just to allow it to operate or to turn it off using a PIN code or programmed imprinting.

10—Equipped with an efficient and ready system, with God Help, to deter and repression of any vehicle intrudes the gate with the intention to pass the gate to be exploded inside as it provides the following:
   a. When the vehicle exploded inside the device, the device itself controls the blast strength and the direction of fragments.
   b. Weakening, constrain, and absorb the explosion.
   c. Controlling the direction of the fragments and the explosion so that the employees are safe from being injured and the like. Also, the facility surrounding the site is safe. Taking in consideration that the system operates automatically in less than one second without giving any human command 11—Equipped with weapons detector operates automatically along with the device and according to the gate requirements 12—Equipped with explosives detector that operates automatically along with the device or any other detection device according to the gate requirements.

13—Certain gates operate automatically without human commands at sunset or by the end of the working hours at the facility. This is can be achieved by closing the gate as well as the road and being prepared to detain individuals who climb the gate whatever their number. In case that any one tries to intrude, then the device will operate, and at sunrise the device retunes to carry out its functions assigned to it this device indicates that there is not any need for the manpower by the end of the working hours and can be directed to carry out other duties or to lay them off completely.

14—Equipped with a remote control which facilitates the movement of the guard during the inspection of the vehicles at the gate and which executes the commands of the guard soon and remotely as follows:

a. Closing the gate . . . Opening the gate.
b. Closing the road . . . opening the road.
c. Detaining the vehicle . . . releasing the vehicle.
d. Detaining individuals at the gate . . . releasing individuals at the gate.
e. Turning off the lights . . . turning on the lights.
f. Turning on the alarm bell . . . turning off the alarm bell.
g. Detaining individuals trying to climb the gate . . . releasing them.

15—The traffic signs shall be used at the gate of the trucks as need and as follows:

| Truck/Entry is Prohibited/ Allowed | Cars/Entry is Prohibited/ Allowed |
|---|---|

The device is equipped with a system that deters and suppresses anyone who violates the guiding sign at the gate automatically without giving any human commands.

Reasons for having this system with the device!!!!!! That is because trucks are stronger and more in pushing up while intruding. This system breaks such strength.

16—The reasons behind using the imprinting system or the PIN code among the employees and the device as to be an obstacle before the intruder in case any incident happens to the gaud at the gate. This means that the intruder will not be able to open the gate easily so as not to pass the device safely.

17—The device is equipped with a system that operates against the intruder who walks without using any vehicles and tries to climb the main gate. Then the device starts working as they try to intrude the facility.

18—Equipped with a system that terminates the role of the human guards working at the main gate.

19—Equipped with a system of electronic card and imprinting system for those who are eligible to have it. In addition to having a device for work card showing the entry time of the employee.

20—It counts the number of vehicles getting in through the gate along with identifying the type, number, and date.

21—The vehicle weight is determined upon entering the facility and the difference in weights upon leaving the facility after loading the consignments.

22—It programs the registered vehicles of the employees through their plate numbers to allow them automatically enter the facility to avoid any traffic jams at the main gates at the beginning if the working hours.

23—It is easy to be used by the guards.

24—This device is distinguished for being easy to be used by employees.

25—Effective in carrying out its security functions without introducing human beings to any danger whether the individual committing the violation is:

a. Perpetrator
b. Wandering
c. Mentally ill
d. Underage
e. Drug/Alcohol Addict

26—The duty of the guards is to inspect and resist but once this device is installed, then it will become its own duties to resist, guard, and arrest in case the guard is not available under any circumstances even there are any neglicance or failure to carry out the duties by the guards. It terminates the role of human support to deter the intruders violating the rules.

27—Equipped with a bumper to force the employees to comply with the speed limits according to the traffic sign.

28—The device cannot be seen and nobody feels that there is any device at the main gate.

29—Each main gate has the freedom to select the required specifications and deselect the unnecessary features according to the work nature of the gates whether they are private or public gates.

30—The device allows the vehicles and individuals who comply with the rules to pass by the device equipment safely

The invention claimed is:

1. An integrated security system comprising:

a bumper at an entrance gate;

a first sensor designated to identify metal pieces pre-loaded at a vehicle using an employ identification system;

a second sensor device designated for the vehicle and people as per demand and needs on the integrated security system;

at least one of a weapons detector and explosives detector;

a direct visual imaging device with lighting for inspection of the vehicle to transfer a captured image to a screen;

a beam device disposed on at least one traffic signal, the beam device operating in accordance with an output signal of the at least one traffic signal;

a basement room, wherein a surface of a ceiling of the basement room serves as a track and is equipped with studs, the track comprising a speed bump;

hydraulic pistons that facilitate movement of the surface of the ceiling of the basement room; and a computer and a control unit to operate the integrated security system through the use of electric or hydraulics plugs;

wherein the at least one of the weapons detector, and explosive detector, the direct visual imaging device, and lighting are configured to operate simultaneously in response to a single command to inspect the vehicle;

wherein in response to the weapons detector or the explosive detector detecting any weapons or explosives, respectively in the vehicle, an electronic signal is output instructing all components of the integrated security system to provide a comprehensive security protection and further instructing lifting of a rear clamp barrier tied to a wire cable to lift the vehicle from a backside to force it towards a fenders room, the fenders room surrounded by security isolators.

2. The integrated security system in accordance with claim 1, where the bumper includes an electronic weighing scale at a bottom of the bumper that weighs the vehicle passing over the bumper.

3. The integrated security system in accordance with claim 1, where the first sensor identifies an employee's vehicle via the metal pieces attached to the vehicle.

4. The integrated security system in accordance with claim 1, wherein the second sensor orders the integrated security system to process one vehicle only to avoid duplication of the entry of several vehicles.

5. The integrated security system in accordance with claim 1, wherein the basement room is linked to the screen and to a guard's room for inspection of vehicles in the basement room.

6. The integrated security system in accordance to claim 1, further comprising a second gate between the entrance gate and the at least one traffic signal.

7. The integrated security system of claim 1, wherein a command is directed to the beam device in correspondence with the operation of the at least one traffic light, the command allowing the vehicle or persons to go beyond device components safely.

8. The integrated security system in accordance with claim 1, wherein the studs of the surface are operable to open and close using a piston activated by a guard, wherein the surface goes down from a front side where a weight is attached to the vehicle, and a rubber spring to avoid collision with the room floor as well as the ceiling is connected with the hydraulic pistons to raise and lower the surface supported by iron bridges to open the track.

9. The integrated security system in accordance with claim 1, further comprising:

insulators;

cement works to resist and absorb a possible blast of the vehicle trapped by the integrated security system; and a fire extinguisher with sensors;

nets inside and around the sides of the integrated security system which rise up upon demand.

10. The integrated security system in accordance with claim 1, wherein in response to a command by a third sensor included on the track, an alarm bell, a vibrator, a camera, and curly confusing lighting are activated.

11. The integrated security system according to claim 1, wherein a main gate of the integrated security system is equipped with sensors which output a signal in response to detecting individuals climbing the main gate.

12. The integrated security system according to claim 1, further comprising:

a wireless signal receiver which receives commands for running the integrated security system.

13. The integrated security system according to claim 1, further comprising:

concrete work along sides of the track to organize traffic by forcing vehicles to pass over the surface.

14. The integrated security system according to claim 1, wherein the computer, by way of the control unit, automatically controls the integrated security system after the end of the working hours, at sunrise, or at sunset.

15. The integrated security system according to claim 1, wherein the computer controls the integrated security system and issues commands for manual functions to be performed by the guard at the gate.

16. The integrated security system according to claim 1, further comprising an alarm bell, wherein an alarm of the alarm bell alarm bell notifies the guard that the integrated security system is operational or that the gate was exposed to unauthorized entry.

17. The integrated security system according to claim 1, further comprising asphalt and driving markers on the surface.

18. The integrated security system according to claim 1, wherein the first sensor identifiers an incoming employee's entry time.

19. The integrated security system according to claim 9, further comprising a wire cable with a first end attached to the net and a second end attached to the surface.

20. The integrated security system according to claim 1, further comprising a fire extinguisher including fire sensors.

21. The integrated security system according to claim 1, further comprising a site for collecting and draining rain water and waste.

22. The integrated security system according to claim 1, further comprising an emergency door which is operable to be opened from any part of the room.

* * * * *